US006039442A

United States Patent [19]

Hagiwara et al.

[11] Patent Number: 6,039,442

[45] Date of Patent: Mar. 21, 2000

[54] ELECTROSTATIC INK JET RECORDING DEVICE HAVING A STIRRING SYSTEM

[75] Inventors: Yoshihiro Hagiwara; Junichi Suetsugu; Tadashi Mizoguchi; Hitoshi Minemoto; Hitoshi Takemoto; Kazuo Shima; Toru Yakushiji, all of Niigata, Japan

[73] Assignee: NEC Corporation, Japan

[21] Appl. No.: 08/996,804

[22] Filed: Dec. 23, 1997

[30] Foreign Application Priority Data

Dec. 23, 1996 [JP] Japan ..... 8-348588

[51] Int. Cl.[7] ..... B41J 2/18

[52] U.S. Cl. ..... 347/89

[58] Field of Search ..... 347/84, 85, 86, 347/87, 89

[56] References Cited

U.S. PATENT DOCUMENTS

| | | | |
|---|---|---|---|
| 4,476,472 | 10/1984 | Aiba et al. | 347/86 |
| 4,680,696 | 7/1987 | Ebinuma et al. | 347/85 |
| 5,159,348 | 10/1992 | Dietl et al. | 347/89 |

FOREIGN PATENT DOCUMENTS

| | | |
|---|---|---|
| 57-199664 | 12/1982 | Japan . |
| 60-110458 | 6/1985 | Japan . |
| 61-227059 | 10/1986 | Japan . |
| 3-213350 | 9/1991 | Japan . |
| 4-125161 | 4/1992 | Japan . |
| 4-216940 | 8/1992 | Japan . |
| 4-261860 | 9/1992 | Japan . |

*Primary Examiner*—Huan Tran
*Assistant Examiner*—Michael Nghiem
*Attorney, Agent, or Firm*—Ostrolenk, Faber, Gerb & Soffen, LLP

[57] ABSTRACT

An electrostatic ink jet recording device has a bypass tube for circulation of the ink while bypassing the ink chamber, for obtaining a uniform concentration of toner in the ink. The recording device operates first in an ink stirring mode for stirring the ink in the ink reservoir for a uniform concentration of the toner, then in an ink replacement mode for replacing the ink in the ink chamber by the ink in the ink reservoir, and in a normal operation mode for effecting a normal recording of data.

7 Claims, 4 Drawing Sheets

ELECTROSTATIC INK JET RECORDING DEVICE HAVING A STIRRING SYSTEM

BACKGROUND OF THE INVENTION (a) Field of the Invention

The present invention relates to an electrostatic ink jet recording device having a stirring system for circulating the ink in an ink reservoir by bypassing an ink chamber.

(b) Description of the Related Art

Electrostatic ink jet recording devices have been proposed comprising a stirring mechanism for an ink chamber to maintain the density or concentration of toner particles in pigmented ink at a constant across the ink chamber of the ink jet recording head.

Patent Publication No. JP-A-4(1992)-216940 proposes a stirring mechanism implemented by a ultrasonic actuator, which is disposed on the outer wall of the ink jet recording head. The ultrasonic actuator generates ultrasonic wave in the ink chamber to dissolve and distribute agglomerated pigment in the ink in the ink jet recording head.

Patent Publication No. JP-A-60(1985)-110458 proposes another stirring mechanism, which is disposed in a second chamber of an ink reservoir of the ink jet recording head. The stirring mechanism comprises a rotating blade member for generating a stirring flow of the ink in the second chamber.

Patent Publication No. JP-A-61(1986)-227059 proposes another stirring mechanism implemented by a combination of a jet nozzle and an uneven surface of the inner wall of the ink chamber, or pump , screw or a vibrator for stirring the ink in the ink chamber.

Those proposed ink stirring mechanisms are effective to provide a uniform concentration of the toner particles in the ink to some extent for an excellent image quality. However, those mechanisms have respective problems such as high costs, complicated configurations, or reliability of the mechanism.

SUMMARY OF THE INVENTION

It is an object of the present invention to provide an electrostatic ink jet recording device having an ink stirring system capable of providing a uniform concentration of the toner in the ink chamber with a relatively simple mechanism, thereby achieving an excellent image quality of the recording.

The present invention provides an electrostatic ink jet recording device comprising an ink jet recording head defining an ink chamber having an ink ejection slit, an ink reservoir receiving therein pigmented ink, and a circulation section for circulating the pigmented ink between the ink chamber and the ink reservoir, the circulation section including first and second tubes both connected between the ink chamber and the ink reservoir, a bypass tube, having a first valve therein and installed between a first point of the first tube and a second point of the second tube, for bypassing the ink chamber, a second valve installed in the first tube between the ink chamber and the first point, a third valve installed in the second tube between the ink chamber and the second point, and a pump for circulating the ink through at least a portion of the first and second tubes.

In accordance with the electrostatic ink jet recording device according to the present invention, a stirring system can be implemented by a relatively simple additional mechanism including valves and a bypass tube. The stirring system has also an advantage in that it has a high reliability in operation because of the simple mechanism thereof.

The above and other objects, features and advantages of the present invention will be more apparent from the following description, referring to the accompanying drawings.

PREFERRED EMBODIMENTS OF THE INVENTION

Now, the present invention is more specifically described with reference to accompanying drawings.

Figure 1:
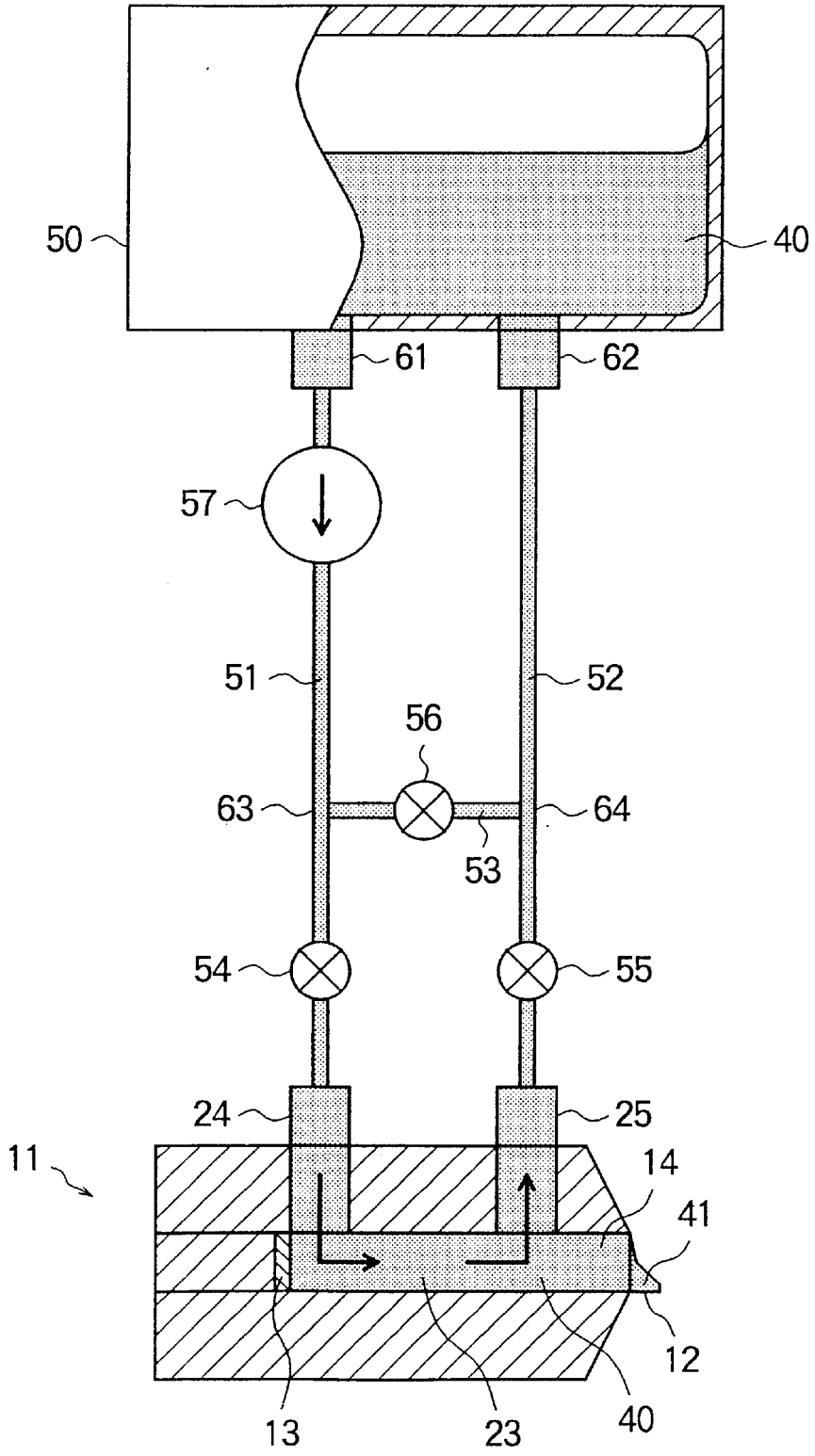
FIG. 1 is a schematic diagram of an electrostatic ink jet recording device according to an embodiment of the present invention.

Referring first to FIG. 1, an electrostatic ink jet recording device according to an embodiment of the present invention comprises an ink jet recording head 11 for ejecting pigmented ink toward a recording sheet not shown, an ink reservoir 50 receiving therein pigmented ink 40 wherein electrified toner particles are dissolved in an insulating solvent, and an ink circulation section for circulating the pigmented ink between the ink jet recording head 11 and the ink reservoir 50. The ink reservoir 50 comprises an ink supply port 61 and an ink return port 62 for circulation of the ink 40.

The ink jet recording head 11 defines an ink chamber 23 for receiving therein pigmented ink 40, and comprises an electrophoretic electrode 13, disposed at the rear wall of the ink chamber 23, for generating an electrophoretic force to move the electrified toner particles in the ink toward the ink ejection slit 14 of the ink chamber 23, a plurality of ejecting electrodes 12 arranged along the ink ejection slit 14 of the ink chamber 23 for ejecting toner particles in the pigmented ink 40 from the ink meniscus 41 formed at the ink ejection slit 14. The ink chamber 23 has an ink inlet port 24 and an ink outlet port 25 for circulation of the ink.

The ink circulation section comprises a first tube 51 connected between the inlet port 24 of the ink chamber 23 and the ink supply port 61 of the ink reservoir 50 for supplying the ink from the ink reservoir 50 to the ink chamber 23, a second tube 52 connected between the ink outlet port 25 of the ink chamber 23 and the ink return port 62 of the ink reservoir 50 for returning the ink from the ink chamber 23 to the ink reservoir 50, and a bypass tube 53, having a bypass valve 56 therein, for bypassing the ink chamber 23 during the stirring circulation of the ink in the ink reservoir 50.

A circulation pump 57 is disposed in the first tube 51 between the ink supply port 61 of the ink reservoir 50 and the connection point 63 of the first tube 51 connecting the first tube 51 with the bypass tube 53. An inlet valve 54 and an outlet valve 55 are disposed between the bypass point 63 of the first tube 51 and the ink inlet port 24 of the ink chamber 23 and between the bypass point 64 of the second tube 52 and the ink outlet port 25 of the ink chamber 23, respectively.

Figure 2:
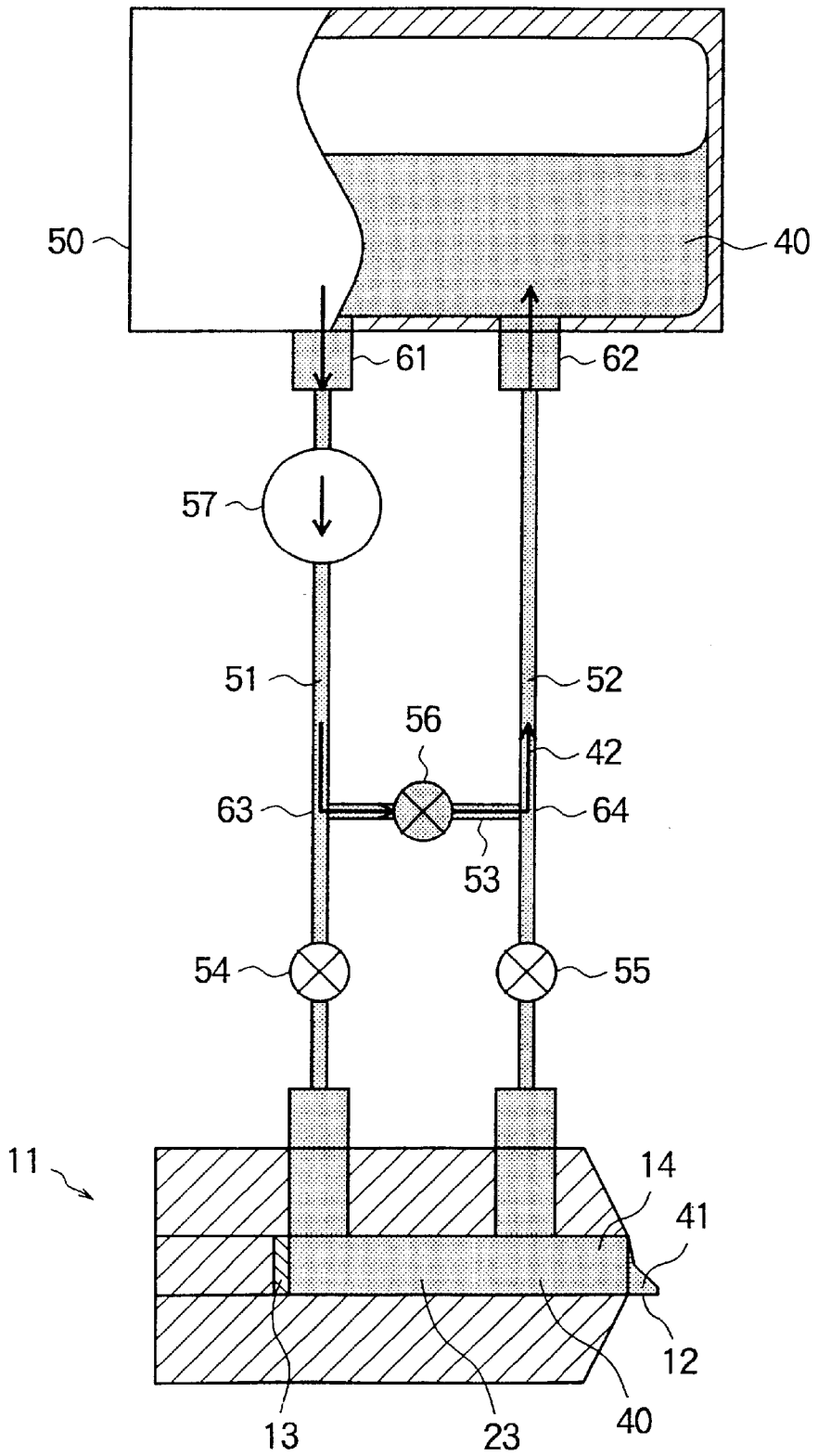
FIG. 2 is a schematic diagram of the electrostatic ink jet recording device of FIG. 1 in an ink circulative mode.

The electrostatic ink jet recording head of the present embodiment operates in three modes of operation including ink stirring mode, ink replacement mode and normal operation mode. The stirring mode is effected by circulation of the ink in the ink reservoir 50 for leveling the concentration of the toner in the ink within the ink reservoir 50, with the bypass valve 56 opened and the remaining valves 54 and 55 closed, as shown in FIG. 2. In this step, the circulation pump 57 circulates the ink 40 in the ink reservoir 50 through a portion of the first tube 51, bypass point 63, bypass valve 56, bypass point 64 and a portion of the second tube 52 to the reservoir 50, as shown by the arrows in FIG. 2, for stirring the ink in the ink reservoir 50. The flow rate of the ink is set at a higher rate than the normal flow rate in the normal operation mode. The normal flow rate is generally specified in the ink jet recording device at a value corresponding to the designed pressure at which ink leakage does not occur at the ink ejection slit 14 of the ink jet recording head 11 during the normal operation mode.

Figure 3:
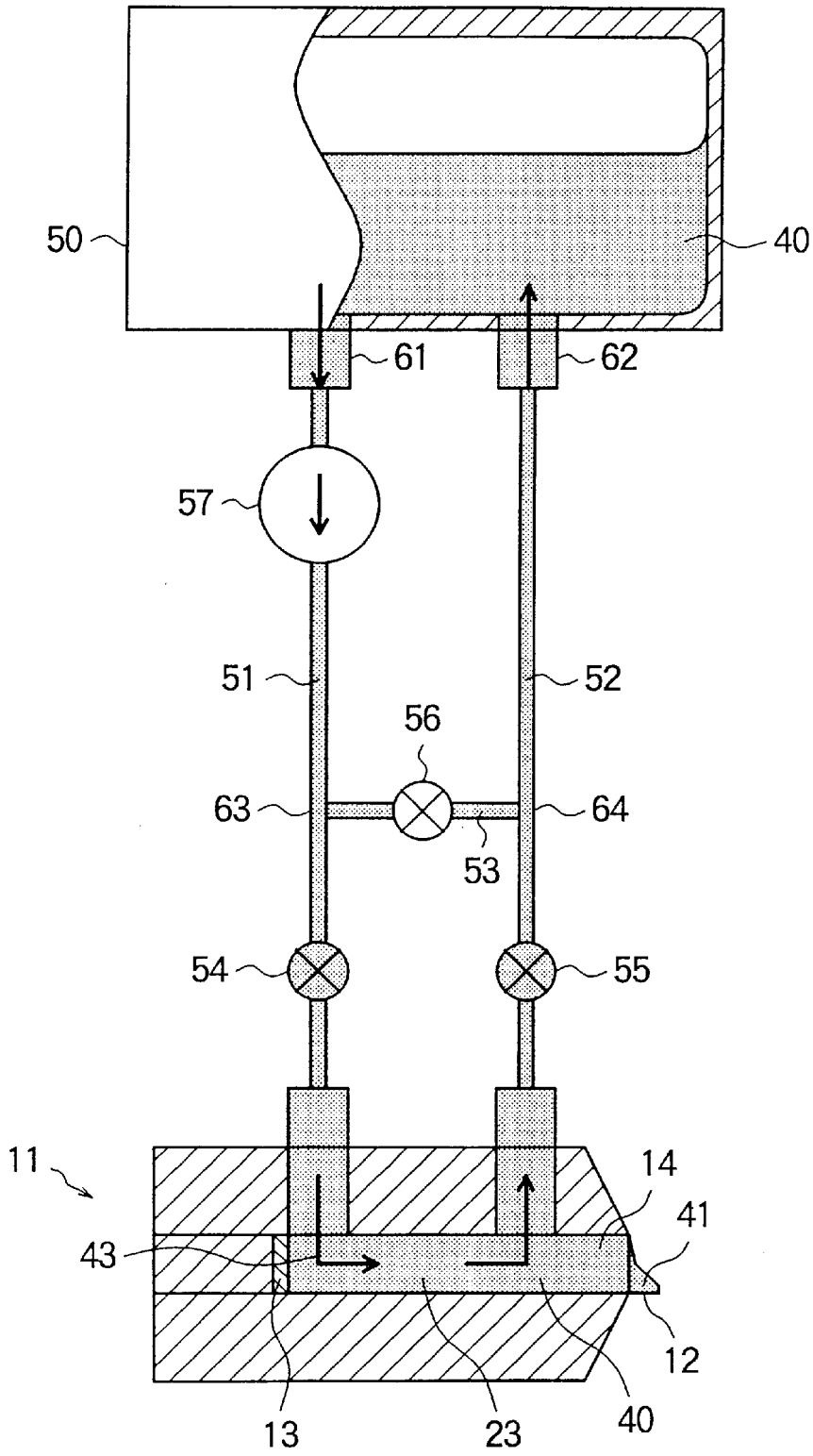
FIG. 3 is a schematic diagram of the electrostatic ink jet recording device of FIG. 1 in an ink replacement mode.

The ink replacement mode and normal operation mode are effected with the bypass valve 56 closed and the remaining valves 54 and 55 opened, as shown in FIG. 3. During these modes, the circulation pump 57 circulates the ink 40 between the ink reservoir 50 and the ink chamber 23 through the first tube 51, inlet valve 54, ink chamber 23, outlet valve 55 and second tube 52, as shown by the arrows in FIG. 3. The ink replacement mode is effected at a higher flow rate than the normal flow rate for replacing the ink in the ink chamber 23 having an ununiform concentration of the toner by the ink in the ink reservoir 23 having a uniform concentration of the toner. The normal operation mode is effected for recording data onto a recording sheet by injecting the ink in the ink reservoir 23 through the ink ejection slit 14 while supplying the ink from the ink reservoir 50.

Figure 4:
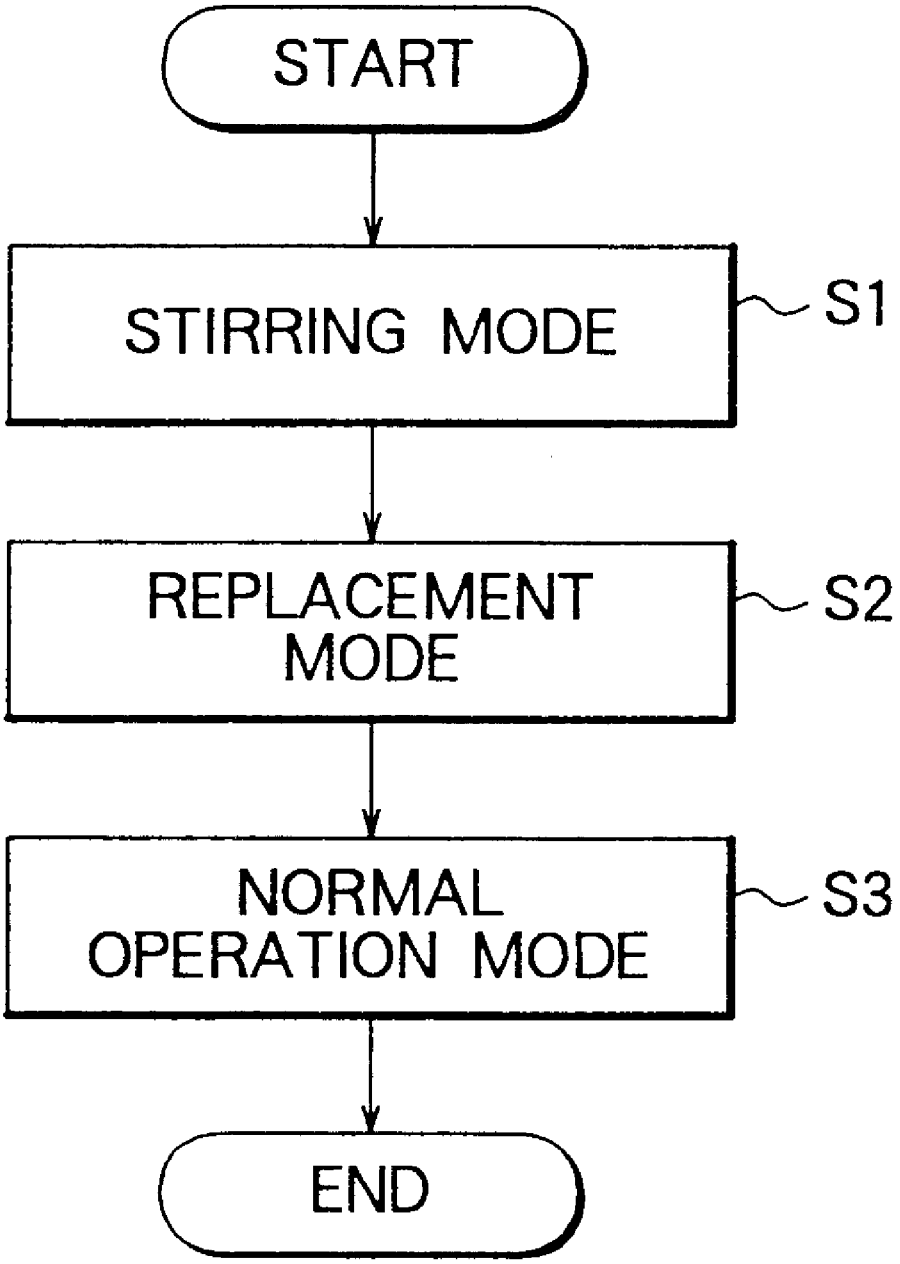
FIG. 4 is a flowchart of the electrostatic ink jet recording device of FIG. 1.

Referring to FIG. 4, there is shown a flowchart for the electrostatic ink jet recording device of the present embodiment after a stop of operation for a relatively long time, which generally causes an ununiform concentration of the toner across the ink chamber. When the ink jet recording device receives a control signal for a start of operation after a relatively long stop, the ink jet recording device operates in an ink stirring mode at the higher flow rate for a specified time length, at step S1, with the bypass valve 56 opened and the remaining valves 54 and 55 closed, then operates in an ink replacement mode at the higher flow rate for a specified time length, at step S2, with the bypass valve 56 closed and the remaining valves 54 and 55 opened, and then operates in a normal operation mode in accordance with the external data signal at the normal flow rate, at step S3, with the state of the valves 54 to 56 unchanged. The time lengths for the ink stirring mode and the ink replacement mode are experimentally determined in the design of the ink jet recording device for obtaining a uniform concentration of the toner in the ink chamber and an excellent image quality of the recording.

Since the above embodiments are described only for examples, the present invention is not limited to the above embodiments and various modifications or alterations can be easily made therefrom by those skilled in the art without departing from the scope of the present invention.

What is claimed is:

1. An electrostatic ink jet recording device, comprising:

an ink jet recording head defining an ink chamber having an ink ejection slit;

an ink reservoir operable to receive pigmented ink therein; and a circulation section operable to circulate said pigmented ink between said ink chamber and said ink reservoir, said circulation section including:

a first tube having a first point and a second tube having a second point, said first and second tubes each coupled between said ink chamber and said ink reservoir, a bypass tube coupled between said first point and said second point for bypassing said ink chamber, said bypass tube having a first valve therein, a second valve disposed in said first tube between said ink chamber and said first point, a third valve disposed in said second tube between said ink chamber and said second point, and a pump disposed in said circulation section, said pump circulating the ink at least through said first and second tubes.

2. An electrostatic ink jet recording device as defined in claim 1, wherein said recording device operates in an ink stirring mode for a specified time length, with said first valve opened and said second and third valves closed.

3. An electrostatic ink jet recording device as defined in claim 2, wherein a flow rate of the ink in said ink stirring mode is higher than a normal flow rate in a normal operation mode.

4. An electrostatic ink jet recording device as defined in claim 2, wherein said recording device operates in an ink replacement mode subsequent to said ink stirring mode for a specified time length, with said first valve closed and said second and third valves opened.

5. An electrostatic ink jet recording device as defined in claim 4, wherein a flow rate of the ink in said ink replacement mode is higher than a normal flow rate in a normal operation mode.

6. An electrostatic ink jet recording device as defined in claim 4, wherein said recording device operates in a normal operation mode subsequent to said ink replacement mode, with said first valve closed and said second and third valves opened.

7. An electrostatic ink jet recording device as defined in claim 6, wherein a flow rate of the ink in each of said ink stirring mode and ink replacement mode is higher than a normal flow rate of the ink in said normal operation mode.

* * * * *